US005078637A

United States Patent [19]

McFarland

[11] Patent Number: 5,078,637

[45] Date of Patent: Jan. 7, 1992

[54] FLEXIBLE FLYING DISC WITH EDGE TUBE

[75] Inventor: Martin A. McFarland, Boulder, Colo.

[73] Assignee: Carpe Diem Imagineering, Inc., Boulder, Colo.

[21] Appl. No.: 662,757

[22] Filed: Mar. 1, 1991

[51] Int. Cl.[5] ..... A63H 27/00; A63B 65/10

[52] U.S. Cl. ..... 446/46; 446/48; 273/424

[58] Field of Search ..... 446/17, 46, 47, 48, 446/220, 225, 486, 450, 34; 273/424, 428

[56] References Cited

U.S. PATENT DOCUMENTS

| | | | |
|---|---|---|---|
| 82,425 | 9/1868 | Lucey | 446/450 |
| 2,804,123 | 8/1957 | Kling | 446/220 X |
| 2,984,937 | 5/1961 | Rendon | 446/450 |
| 3,935,668 | 2/1976 | Phillips, Jr. | 446/450 |
| 3,948,523 | 4/1976 | Michael | 446/47 X |
| 4,115,946 | 9/1978 | Vukmirovich | 446/27 |
| 4,201,009 | 5/1980 | Burridge, Jr. | 446/27 |
| 4,335,536 | 6/1982 | Magid et al. | 446/46 |
| 4,709,928 | 12/1987 | Willingham | 446/46 X |

FOREIGN PATENT DOCUMENTS

| | | | |
|---|---|---|---|
| 1400474 | 7/1975 | United Kingdom | 446/46 |
| 2076671 | 12/1981 | United Kingdom | 446/46 |

*Primary Examiner*—David N. Muir

*Attorney, Agent, or Firm*—Donald W. Margolis; Edwin H. Crabtree

[57] ABSTRACT

A flexible flying disc used for play by adults and children as a retrieval toy for animals, particularly dogs. The disc is characterized by having an aerodynamic design for long and stable flight similar to rigid discs, yet is made of soft, flexible material which eliminates harm to humans and damage to the mouths of any animal catching it. The lower edge is made of an abrasion-resistant material which allows the disc to land and be skipped off hard surfaces without damaging the disc. A flexible tube within the disc provides a spring type action for maintaining the shape of the disc or for returning the disc to its original shape when the disc is folded or pulled out of shape. When the disc is tossed, it has a circular dome which inflates upwardly providing an air foil effect, while a lower edge, wrapped around the tube defines a toroid which provides a gyroscopic effect lending stability to the flight as the disk spins through the air. The dome includes a leading edge and a trailing edge, and the circular edge of the dome is offset from the leading and trailing edge of the disc, thereby reducing the laminar flow across the upper convex surface of the disc and in turn reducing drag thereon for longer flight.

20 Claims, 1 Drawing Sheet

FLEXIBLE FLYING DISC WITH EDGE TUBE

BACKGROUND OF THE INVENTION (a) Field of the Invention

This invention relates to a flexible flying disc used as a toss and fetch retrieval toy, and more particularly, to a flexible flying disc having an improved aerodynamic design for longer and more stable flight. It also relates to such a flexible flying disc which includes an abrasion-resistant bottom material protects the bottom of the disc when it lands on hard surfaces.

(b) Discussion of Prior Art

Heretofore there have been a variety of disc shaped toss and fetch retrieval toys made of rigid material, with the most common being sold under the trademark "Frisbee". None of the rigid disc toys is believed to be pertinent to the present invention.

There have also been a variety of disc shaped toss and fetch retrieval toys made of flexible material. Of these, perhaps the two of greatest interest may be Vukmirovick U.S. Pat. No. 4,115,946 and Brown U.S. Pat. No. 4,223,473. Vukmirovick U.S. Pat. No. 4,115,946 teaches a disc having a body made of flexible material, and including a hemmed circumferential edge of circular cloth fabric which carries a number of small metal weights or a continuous metal cable around the circumferential edge. The disc can be folded for placing in a pocket, used as a beanie, and tossed through the air. This disc has been tested by applicant and has been found to have mediocre aerodynamic characteristics. Brown U.S. Pat. No. 4,223,473 describes a soft flying game disc which has a spoiler skirt around its periphery for enhanced lift and flight stability. They both include a structure in which a circular, flexible convex dome inflates upwardly during thrown flight due to differential air pressure.

Other known disc shaped toss and fetch retrieval toys made of flexible material, primarily unitary structures of elastomeric material and polyurethane foam are Linenfelser U.S. Pat. No. 3,710,505, Hembree, et al. U.S. Pat. No. 4,196,540; and Moormann, et al. U.S. Pat. No. 4,737,128. Also, flying discs made of flexible fabric material are described in Stauffer U.S. Pat. No. 4,290,226 and Walker U.S. Pat. No. 4,279,097 to Walker. None of the abovementioned patents are similar in structure when compared to the subject invention, nor do they provide the advantages which are disclosed herein.

SUMMARY OF THE INVENTION

In view of the foregoing, it is an object of the present invention to provide a flexible flying disc that is aerodynamically sound in design, stable in flight, will fly far, and has an air foil and a gyroscopic effect as it spins through the air.

Another object of the invention is to provide a flying disc made of a soft yet tough flexible sheet material which eliminates damage to the teeth and gums of a dog catching the flying disc in its mouth. Further, because of the flexible material, any danger of hitting and hurting another person or child in a crowded area is greatly reduced as compared to flying a hard plastic flying disc. Also, because the disc is flexible, when the disk is lying on a flat surface, it can be easily picked up and retrieved by a dog, as compared to a hard plastic disc which is often difficult for a dog to pick up on his own.

Still another object of the invention is to provide a disc that is lightweight, rugged in construction, can be folded for carrying in a pocket, and can be stretched out of its original shape when playing with a dog gripping the disc. When released the disc will spring back into its natural shape. The flexible material is made of a tough, lightweight type material which is difficult to tear, and can be easily cleaned, such as nylon, ripstop nylon and the like.

Yet another object of the invention is to provide a disc which includes an abrasion-resistant material around the bottom edge so that the disc can land and be skipped off hard surfaces without being damaged, and accordingly, the wear life of the disc is greatly extended.

A further object of the invention is to provide a flexible disc which can be used for water play with a hollow tube enclosed around the toroidal edges of the disc providing buoyancy and an interior flexible circular dome waterproofed so that the disc can be used as a water dish during and after play with a thirsty pet.

Another object of the invention is to provide a flexible disc designed for longer flight by offsetting the interior flexible circular dome from the leading and trailing edges of the disc so that as the disc spins through the air the laminar air flow is reduced as it approaches the trailing edge of the disc and in turn drag is reduced during the flight of the disc.

Yet another object of the invention is to provide the owner of the disc an excellent, high quality, toss-and-fetch toy for the owner's pet and for playing with other adults and children. Heretofore pets have chewed and torn apart a hard plastic flying disc and ingested a portion of the hard plastic, causing stomach problems for the dog. While a pet can chew and pull on the flexible disc, the disc with its tough flexible material is difficult if not impossible to chew through.

The present invention includes a flying disc having a flexible circular dome. The dome has a circular edge joined to an inner circular edge of an upper flexible peripheral ring member. The upper member extends outwardly along a horizontal plane and then curves downwardly where an outer circular edge of the upper member is joined to an outer circular edge of a lower flexible peripheral ring member made of an abrasion-resistant material. The lower member is curved downwardly and then upwardly where an inner circular edge of the lower member is joined to the circular edge of the dome. The upper and lower members form an annular interior void for receiving a flexible rubber tube therein. The tube is placed in the void, preferably under compression for providing a spring like resiliency in returning the disc to its natural shape when the disc if folded and pulled out of shape. The abrasion-resistant material of the lower member allows the disc to land and be skipped off hard surfaces without damaging the disc.

When the disc is tossed, the circular dome inflates upwardly providing an air foil effect. The curved upper and lower members wrapped around the tube provide a toroidal leading edge which provides a gyroscopic effect lending stability to the flight as the disc spins through the air. Further, the circular edge of the dome is offset from the leading and trailing edge of the disc, thereby reducing the laminar flow across the upper convex surface of the disc and in turn reducing drag thereon for longer flight.

These and other objects of the present invention will become apparent to those skilled in the art from the following detailed description, showing the contemplated novel construction, combination, and elements as herein described, and more particularly defined by the appended claims, it being understood that changes in the precise embodiments of the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof, and in which.

DESCRIPTION OF THE PREFERRED EMBODIMENT

Figure 1:
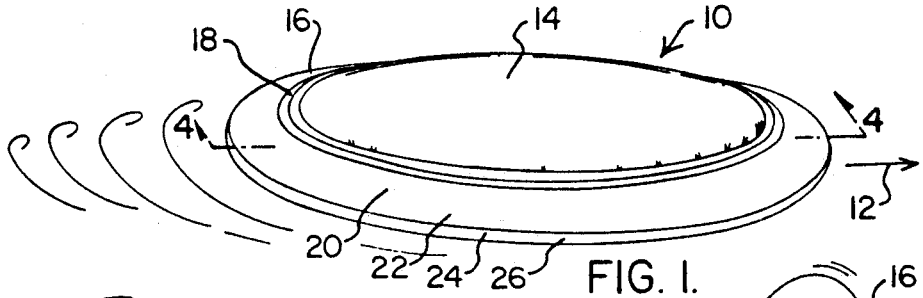
FIG. 1 is a perspective view of the subject flexible flying disc in flight as it spins through the air.
Figure 4:
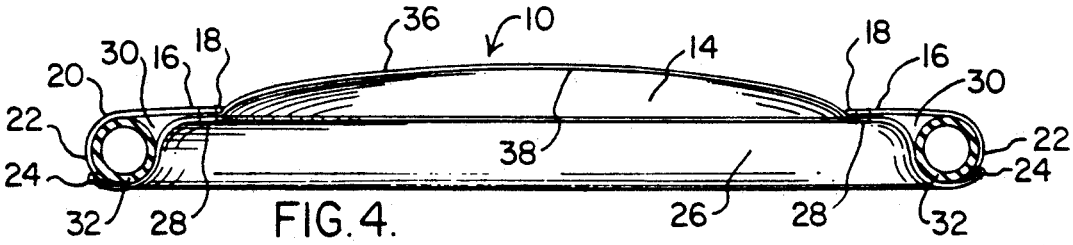
FIG. 4 is a cross-sectional side view of the disc taken along lines 4—4 shown in FIG. 1, showing the internal structure of the disc.
Figure 5:
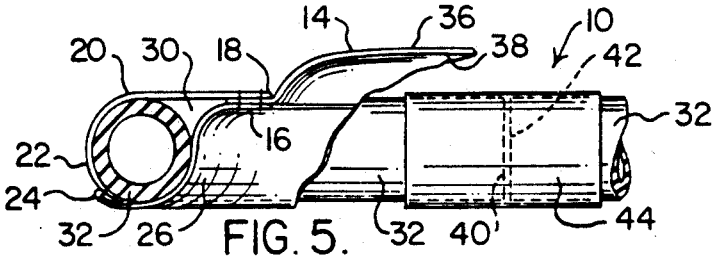
FIG. 5 is an enlarged cross-sectional side view of a portion of the disc, and showing an outer sleeve used to join the ends of a flexible tube which is enclosed by a portion of flexible fabric.

In FIG. 1 the subject flexible flying disc is shown flying through the air and is designated by general reference numeral 10. The disc 10 is shown moving from left to right as indicated by arrow 12. The disc 10 has an air foil toroidal shape not unlike the well-known hard plastic flying discs that are available commercially. The disc 10 broadly includes a flexible circular dome 14 having a circular edge 16 joined to an inner circular edge 18 of an upper flexible peripheral ring member 20. The upper member 20 extends outwardly along a horizontal plane and then curves downwardly where an outer circular edge 22 is joined to an outer circular edge 24 of a lower flexible peripheral ring member 26. The dome 14 and upper member 20 are made of a lightweight, but strong 420 denier nylon type material, like that which is used in making backpacks. The lower member 26 is made of an abrasion resistant material, such as 1000 denier Cordura nylon so that the disc 10 can land and be skipped off hard surfaces without causing excessive wear on the disc 10. The lower member 26 is curved downwardly and then upwardly, as shown in FIGS. 4 and 5, where an inner circular edge 28 is joined to the circular edge 16 of the dome 14. The upper and lower members 20 and 26 form a semi-annular interior void 30 for receiving a flexible elastomeric tube 32 made, for example of a soft durable rubber which is not temperature sensitive and has a memory for returning to its natural shape after being compressed. The void 30 and tube 32 are shown in cross section in FIGS. 4 and 5.

Figure 2:
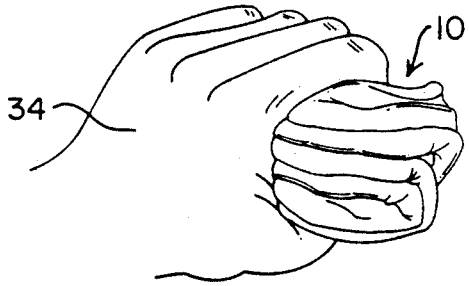
FIG. 2 and FIG. 3 are perspective views of a human hand folding the disc for storage and then releasing the disc, respectively, to illustrate how the disc springs back to its original shape.
Figure 3:
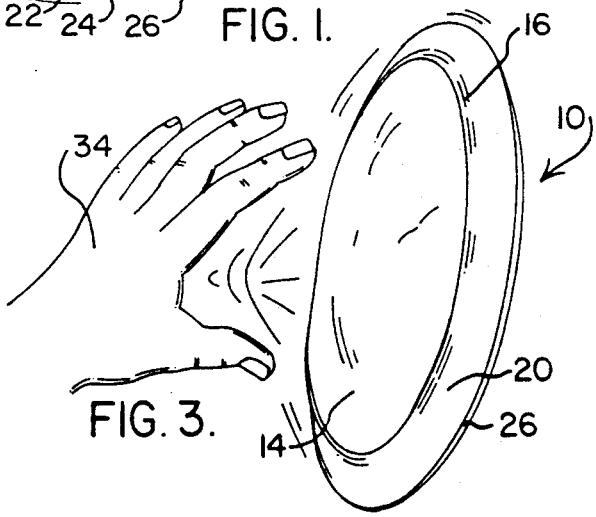

In FIG. 2 a human hand 34 is shown having folded the disc 10 for storing in a pocket or the like and then the hand 34, in FIG. 3, is shown releasing the disc 10 which immediately resumes its original flying shape as shown in FIG. 1. The disc's ability to resume its natural flying shape is caused by the built-in memory of the flexible tube 32 returning to its shape after being compressed when folded, but also when the tube 32 is received in the void 30 the tube 32 is compressed therein. In preferred embodiments, the overall length of the tube 32 is greater than the circumference of the void 30, whereby when the tube 32 is placed in the void, before its ends are connected to form a ring, it is compressed within the void causing tension against the interior sides of the upper and lower members 20 and 26. By compressing the tube 32 in the void 30 not only is the spring-like quality of the disc 10 improved, but the compressed tube 32 helps provide a smooth surface around the upper and lower members 20 and 26 eliminating any possible wrinkles which might occur in the flexible fabric.

In FIG. 4 a side cross section of the disc 10 is shown taken along lines 4—4 shown in FIG. 1. In this drawing the circular edge 16 of the dome 14 is disposed between the inner edge 18 of the upper member 20 and the inner edge 28 of the lower member 26 and double stitched thereto with any excess material around the edges gathered during the sewing operation. The double stitching and gathering provide clean lines around the circumference of the dome 14 and increased strength and durability. Also in this drawing the hollow tube 32 can be seen in cross section in the void 30 and compressed against the interior sides of the upper and lower members 20 and 26. The flexible circular dome 14 is shown in a relaxed state. Due to the pressure differential when the air stream is split, an exterior convex surface 36 of the dome 14 has less air pressure thereon than an interior concave surface 38 of the dome 14, therefore during flight the dome 14 inflates upwardly aiding the air foil flying characteristics of the disc 10. The interior concave surface 38 is applied with a sealed coating, for example 3/4 ounce polyurethane, to prevent the dome 14 from fraying during the sewing operation and for waterproofing the surface so that the disc can be used as a water dish.

In FIG. 5 a side cross section of a portion of the disc 10 is shown with opposite ends 40 and 42 of the tube 32 joined together using an outer sleeve 44. The sleeve 44 is preferably another elastomeric tube, for example of rubber, which is strong enough to hold tube 32 together in an annular ring shape, but thin enough not to detract from the appearance of the material on the surface of the edge of the disc 10.

Figure 6:
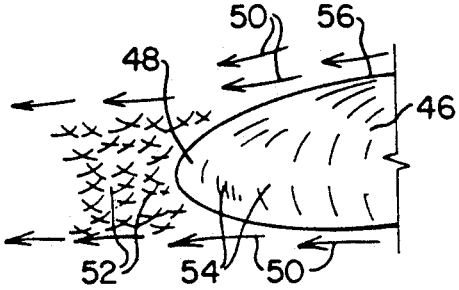
FIG. 6. (PRIOR ART)
FIG. 6 is a side view of a portion of a prior art flying disc with the dome extended downwardly and wrapped around the edge of the disc, and illustrating the air stream and air drag at the trailing edge of the disc.

In FIG. 6 a prior art flying disc is shown with its trailing edge 48 downstream from an air stream shown by arrows 50. It is well known in low speed flying objects such as golf balls, sail planes, model airplanes, and the like, that if laminar flow across a flying surface can be reduced by introducing turbulent flow using trips and sandpaper on wings, dimples on golf balls, and other types of air spoilers, then the drag, shown as hash marks 52, can be reduced and the flying object can fly further. The prior art disc 46 may be a hard plastic disc or a flexible disc with fabric folded over edges 54 of the disc 46. Because the edges 54 and the trailing edge 48, which is part of the edges 54, are smooth the air stream across a convex surface 56 of the disc 46 flows uninterrupted and laminar flow occurs with a certain amount of drag 52 occurring to slow the flight of the disc 46.

Figure 7:
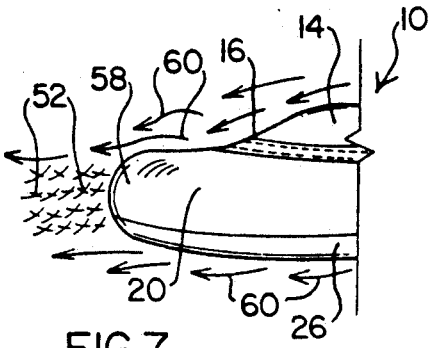
FIG. 7 is a side view of a portion of the subject disc with a circular edge of a flexible dome offset from the edge of the disc, and illustrating the air stream and the reduced air drag at the trailing edge of the disc.

In FIG. 7 the subject flexible flying disc 10 is shown with the circular edge 16 of the dome 14 offset from a trailing edge 58 of the disc 10 so that the laminar flow from an air stream shown by arrows 60 is interrupted. This interruption of the air stream at the trailing edge 58 adds some turbulence thereby reducing the amount of drag 52 and the disc accordingly will fly further. In addition, because the curved upper and lower members 20 and 26 are smoothly wrapped around the annular tube 32 with the tube 32 enclosed therein, the disc 10 is provided with a continuous toroidal leading edge which provides a gyroscopic effect lending stability to the flight as the disc spins through the air.

While the invention has been particularly shown, described and illustrated in detail with reference to preferred embodiments and modifications thereof, it should be understood by those skilled in the art that the foregoing and other modifications are exemplary only, and that equivalent changes in form and detail may be made therein without departing from the true spirit and scope of the invention as claimed, except as precluded by the prior art.

The embodiments of the invention for which an exclusive privilege and property right is claimed are defined as follows:

1. A flexible flying disc having an aerodynamic toroidal air foil shape and useful as a toss and fetch toy, the disc comprising:

a flexible dome having an outer circular edge therearound;

an upper flexible peripheral ring member having an inner circular edge and an outer circular edge, said inner circular edge joined to said outer circular edge of said dome;

a lower flexible peripheral ring member having an inner circular edge and an outer circular edge, said outer circular edge joined to said outer circular edge of said upper member, said inner circular edge joined to said circular edge of said dome, said upper and lower members forming a void therebetween, said lower member being made of abrasion-resistant material so that the disc can land on or be skipped off of hard surfaces without damaging said lower member of said disc; and an annular support member received in said void and held therein.

2. The disc as described in claim 1 wherein said upper member extends outwardly in a horizontal plane from said circular edge of said dome and then curves downwardly before being joined to said lower member.

3. The disc as described in claim 2 wherein said lower member extends downwardly when joined to said upper member and then curves upwardly before being joined to said dome.

4. The disc as described in claim 1 wherein said support member is a flexible rubber tube.

5. The disc as described in claim 4 wherein said tube has a length greater than a circumference around said void so that said tube is held in compression when inserted inside said void.

6. The disc as described in claim 1 wherein said dome includes an exterior convex surface and an interior concave surface, said interior concave surface having a waterproof coating thereon so that the disc can be used as a water dish.

7. The disc as described in claim 1 wherein said upper and lower members are joined to said circular edge of said dome using stitching therearound.

8. A flexible flying disc having an aerodynamic toroidal air foil shape and used for play by adults, children, and as a toss and fetch retrieval toy for animals, particularly dogs, the disc comprising:

a flexible dome having an upper, normally convex surface, a lower, normally concave surface, and a circular outer edge therearound;

an upper flexible peripheral ring member having an inner circular edge and an outer circular edge, said inner circular edge stitched to said outer circular edge of said dome;

a lower flexible peripheral ring member having an inner circular edge and an outer circular edge, said outer circular edge stitched to said outer circular edge of said upper ring member, said inner circular edge stitched to said outer circular edge of said dome, said upper and lower members forming an annular void therebetween; and a flexible tube received in said void.

9. The disc as described in claim 8 wherein said upper member extends outwardly in a horizontal plane from said circular edge of said dome and then curved downwardly before being joined to said lower member.

10. The disc as described in claim 9 wherein said lower member extends downwardly when joined to said upper member and then curves upwardly before being joined to said dome.

11. The disc as described in claim 8 wherein said lower member is made of an abrasion-resistant material so that the disc can land and be skipped off hard surfaces without damaging the disc.

12. The disc as described in claim 8 wherein said tube is made of soft rubber not sensitive to temperature changes.

13. The disc as described in claim 12 wherein said tube has a length greater than the circumference around said void, said tube having opposite ends joined together by an outer sleeve.

14. The disc as described in claim 8 wherein said interior concave surface of said dome has a waterproof coating thereon so that the disc can be used as a water dish.

15. A flexible flying disc having an aerodynamic toroidal air foil shape and used for play by adults, children, and as a toss and fetch retrieval toy for animals, particularly dogs, the disc comprising:

a flexible dome having an upper, normally convex surface, a lower, normally concave surface, and a circular edge therearound;

an upper flexible peripheral ring member having an inner circular edge and an outer circular edge, said inner circular edge joined to said circular edge of said dome, said upper member extending radially outward from said dome in a horizontal plane and then curved downwardly;

a lower flexible peripheral ring member made of abrasion-resistant material and having an inner circular edge and an outer circular edge, said outer circular edge joined to said outer circular edge of said upper member, said lower member curved downwardly from said upper member and then curved upwardly forming a semi-annular void with said lower member joined to said circular edge of said dome; and an annular flexible rubber tube received in said void and held in compression therein.

16. The disc as described in claim 15 wherein said dome and said upper member are made of a lightweight, durable nylon material.

17. A flexible flying disc normally having an aerodynamic air foil, saucer shape, and useful as a toss toy, said disc, when stretched, folded or bent out of its normal saucer shape having a memory which substantially instantly returns it to its normal saucer shape, said disc comprising:

a flexible dome having a circular outer edge therearound;

a flexible peripheral ring defining a toroidal void therein and having an inner circular edge, said inner circular edge of said flexible peripheral ring being joined to said outer circular edge of said flexible dome, said flexible peripheral ring extending outwardly in a horizontal plane from said outer circular edge of said flexible dome in a manner such that said outer circular edge of said flexible dome is offset below an uppermost surface of said flexible peripheral ring in a manner such that a laminar flow from an air stream during flight of said disc is interrupted, adding turbulence and thereby reducing drag;

a cylindrical support member having shape retention money properties received in said toroidal void defined by said flexible peripheral ring, and held therein, said support member holding said flexible dome and said flexible peripheral ring in tension, thereby maintaining the aerodynamic air foil, saucer shape prior to, during and after the flight of said disc.

18. The disc as described in claim 17 wherein said cylindrical support member is a flexible hollow tube.

19. The disc as described in claim 17 wherein said flexible tube is composed of rubber.

20. The disc as described in claim 18 wherein said tube has a length greater than the circumference of said toroidal void so that said tube is held in compression when inside said void.

* * * * *